US008289221B1

(12) United States Patent
Finucane

(10) Patent No.: US 8,289,221 B1
(45) Date of Patent: Oct. 16, 2012

(54) DEPLOYABLE REFLECTARRAY ANTENNA SYSTEM

(75) Inventor: Colin Finucane, Albuquerque, NM (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 325 days.

(21) Appl. No.: 12/824,318

(22) Filed: Jun. 28, 2010

(51) Int. Cl.
*H01Q 13/00* (2006.01)

(52) U.S. Cl. ..... 343/781 R

(58) Field of Classification Search ..... 343/781 R, 343/772, 774–777, 755, 781 P
See application file for complete search history.

(56) References Cited

U.S. PATENT DOCUMENTS

| | | | | |
|---|---|---|---|---|
| 3,550,142 | A * | 12/1970 | Dawson | 343/781 R |
| 5,191,350 | A * | 3/1993 | Hemmie | 343/840 |
| 6,486,851 | B2 * | 11/2002 | Weaver | 343/878 |
| 6,657,589 | B2 * | 12/2003 | Wang et al. | 342/383 |
| 7,999,750 | B2 * | 8/2011 | Mansour et al. | 343/757 |
| 2002/0084947 | A1 * | 7/2002 | Weaver | 343/878 |
| 2007/0021095 | A1 * | 1/2007 | Cheng et al. | 455/403 |

OTHER PUBLICATIONS

Wang, H.S.C., "A comparison of the performance of reflector and phased-array antennas under error conditions", 1991 IEEE Aerospace Applications Conference Digest, p. 4/1-4, 1991.

Pozar, D. M. et al, "Design of Millimeter Wave Microstrip Reflectarrays," IEEE Trans. of Antennas and Propagation, vol. 45, No. 2, Feb. 1997.

* cited by examiner

*Primary Examiner* — Huedung Mancuso
(74) *Attorney, Agent, or Firm* — James M. Skorich; Kenneth E. Callahan

(57) ABSTRACT

A center-fed deployable reflectarray antenna system comprised of a stack of flat reflectarray panels, a deployment mast, a waveguide, and an antenna feed. The flat reflector in its deployed configuration is subdivided about its center into n equal panels. The stowed configuration has the n panels arranged in a vertical stack with each separated from the next by a small distance. Panel mounting brackets are attached to each panel at the center area where they would have converged in their deployed configuration. The deployment mast is a hollow cylinder with guide slots cut through its wall. The bottom panel is fixedly attached to the bottom of the deployment mast while the remaining panels are moveable attached to the guide slots. The guide slots are designed so that when going from the stacked to the deployed configuration each panel is moved with respect to the fixed panel along its guide slots a predetermined angle at which point it is dropped to the plane of the fixed panel. The waveguide is located along the central axis of the deployment mast and the antenna feed attached to the waveguide at the appropriate distance from the antenna reflector.

8 Claims, 7 Drawing Sheets

Deployable Reflectarray Antenna
In Stowed Configuration

Reflectarray Antenna
In Deployed Configuration

Deployment Mast Detail

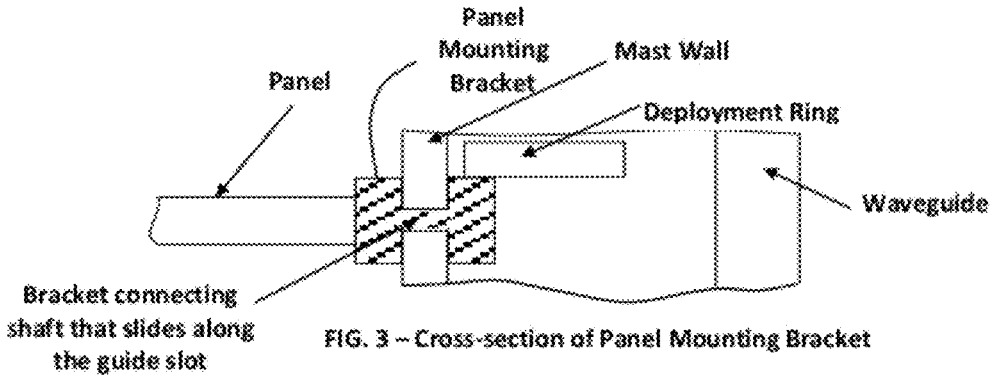
FIG. 3 – Cross-section of Panel Mounting Bracket
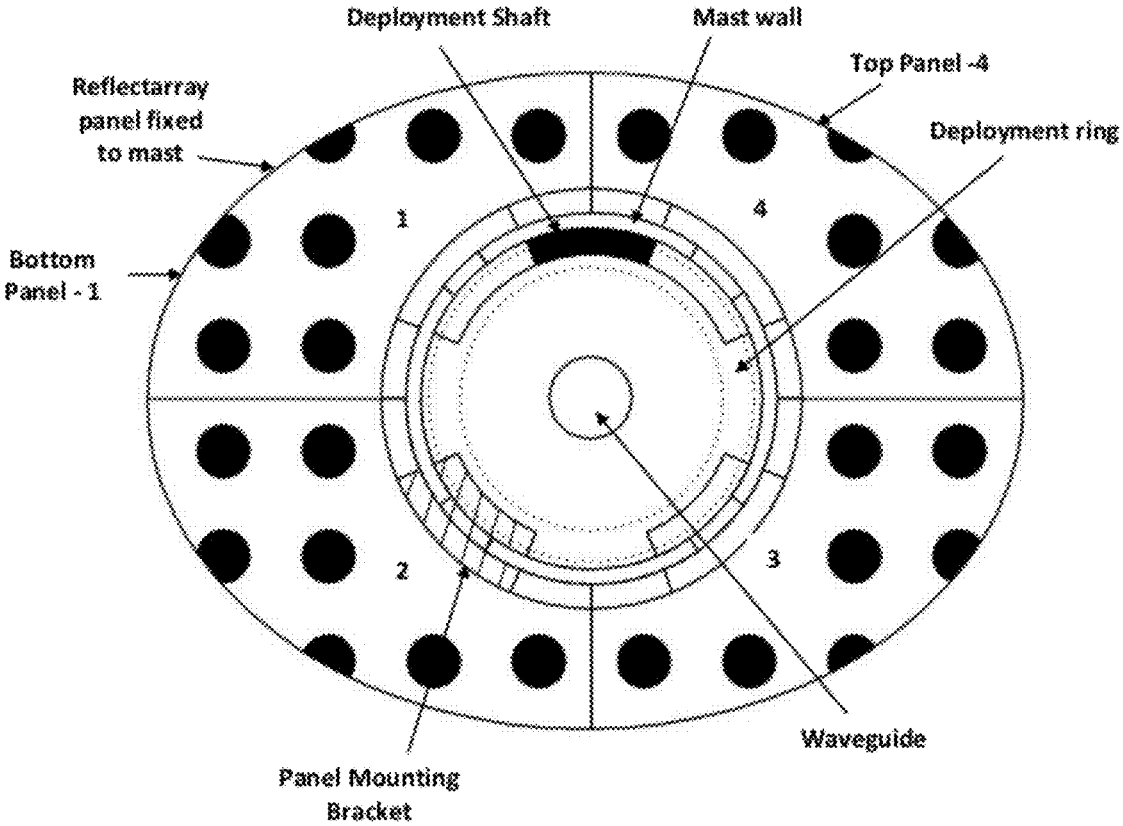
FIG. 4
Top View of Deployment Mast
Panels in Deployed Configuration Cutaway View of Deployment Mast Deployment Mast Wall Flattened
Stowed Configuration
(Panels Not Shown)

Top Panel Partially Deployed

Top and Second Panels Partially Deployed

Fully Deployed Configuration

DEPLOYABLE REFLECTARRAY ANTENNA SYSTEM

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

The invention relates generally to deployable reflector antennas, and in particular to a deployable reflectarray antenna system.

Reflector antennas have a long history of development for various uses in space. The need for antennas with ever larger collection surface areas led to the development of deployable antennas with relatively small stowed footprints that would fit within the limited dimensions of launch vehicle payloads. The bulk of these deployable reflector antennas are parabolic dish structures that are stowed and deployed by a variety of often complex mechanisms. At higher frequencies and larger deployed antenna diameters, it becomes more and more difficult to attain and to thereafter maintain required antenna surface tolerances. Deviations from the desired shape reduce antenna gain and increase undesired side lobes.

Phased array antennas offer a number of benefits for space operations. By controlling the phase of the transmitted or received electromagnetic radiation a great deal of control can be exerted over the resulting beam pattern. Many desirable traits such as the reduction of side lobes and cross-polarized fields in the beam pattern can be designed into even the simplest of phased arrays. By incorporating controllable phase shifters into the feed structure, the beam pattern can be adapted during operation to suit a variety of needs. The planar nature of these arrays can enable a fairly simple deployment mechanism as well. Since the beam pattern primarily depends on the phase of each array element, the surface tolerance of the deployed structure becomes less of an issue. An analysis comparing the characteristics of phased array antennas with reflector antennas can be found in Wang, H.S.C., "A comparison of the performance of reflector and phased-array antennas under error conditions", 1991 IEEE Aerospace Applications Conference Digest, p 4/1-4, 1991.

A reflectarray antenna combines some of the best features of reflector and array antennas. Basically a microstrip reflectarray antenna consists of a flat array of microstrip patches or dipoles printed on a thin dielectric substrate. A feed antenna illuminates the array. The individual microstrip patches are designed to scatter the incident field with the proper phase required to form a planar phase front when a feed is placed at its focus similar to a parabolic reflector. These flat reflectarray antennas can be produced at relatively low cost, with high gain and are particularly effective at high frequencies. Additional details of microstrip reflectarray antennas can be found in Pozar, D. M. et al, "Design of Millimeter Wave Microstrip Reflectarrays," IEEE Trans. Of Antennas and Propagation, Vol. 45, No. 2, February 1997.

Although the losses from microstrip reflectarray antennas are typically less than those of a phased array, they are still greater than those of a fixed aperture parabolic reflector. For example, etching tolerances can introduce phase errors in the reflectors and the dielectric substrate can attenuate the signal.

This results in lower aperture efficiencies and lower gains than are possible with a simple fixed aperture reflector of the same surface area.

Reflectarrays can be less expensive to manufacture than phased arrays or parabolic dishes, and by design they offer a degree of control over the beam pattern superior to that of a parabolic reflector. It is desirable to leverage the established design methods for reflectarrays and the mechanical advantages they offer a deployable structure. With deployable structures lower aperture efficiencies are compensated for with higher gain from increased antenna collection area. If a simple deployment mechanism were available, large aperture reflectarray antennas should become commercially successful for space applications and for terrestrial applications where a small stowed configuration is desirable. This is the intent of the present invention.

SUMMARY

The present invention is a deployable reflectarray antenna system with a simple but effective deployment mechanism. A flat reflectarray antenna is subdivided through the center into n equally sized panels. The panels are then stacked one on top of the other reducing the surface area in the stowed configuration by a factor of nearly 1/n. A hollow cylindrical deployment mechanism is located at the center of the deployed antenna along with a waveguide and antenna feed. One panel is fixedly attached to the bottom of the cylinder. Guide slots are cut through the wall of the cylinder, one for each of the n-1 moveable panels. A panel mounting bracket is attached to each moveable panel near the center point where the panels converge. The panels are moveably attached to the deployment cylinder via the guide slots. In the stacked (stowed) configuration, the panels are separated vertically from each other by a small distance. The guide slots have a slight downward slope so that as the panels are moved along the slots from the stacked to the deployed configuration, they both descend toward the fixed panel and increase in angular displacement relative to the fixed panel. Once the panels have moved their predetermined multiple of 360/n degrees about the cylinder relative to the fixed panel, their guide slot becomes vertical and they are dropped into the plane of the fixed panel. A deployment ring at the top of the panel stack may be used to deploy the panels with a downward movement. Other means for moving the panels may be employed, either simultaneously or sequentially. In the deployed configuration, the individual panels may be secured by the deployment ring or a zero insertion force latch to form a single continuous structure.

BRIEF DESCRIPTION OF THE DRAWINGS

FIG. 3 is a cross-section of a panel mounting bracket.

FIG. 4 is a top view of the FIG. 1 deployment mast in a deployed configuration.

DESCRIPTION OF THE PREFERRED EMBODIMENT

Figure 1A:
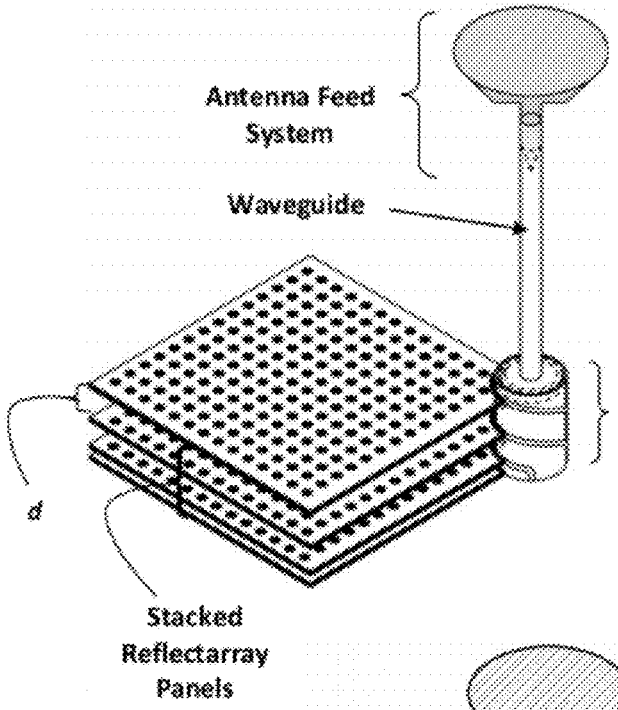
FIG. 1 illustrates a deployable reflectarray antenna in a stowed configuration (1A) and in its deployed configuration (1B).
Figure 1B:
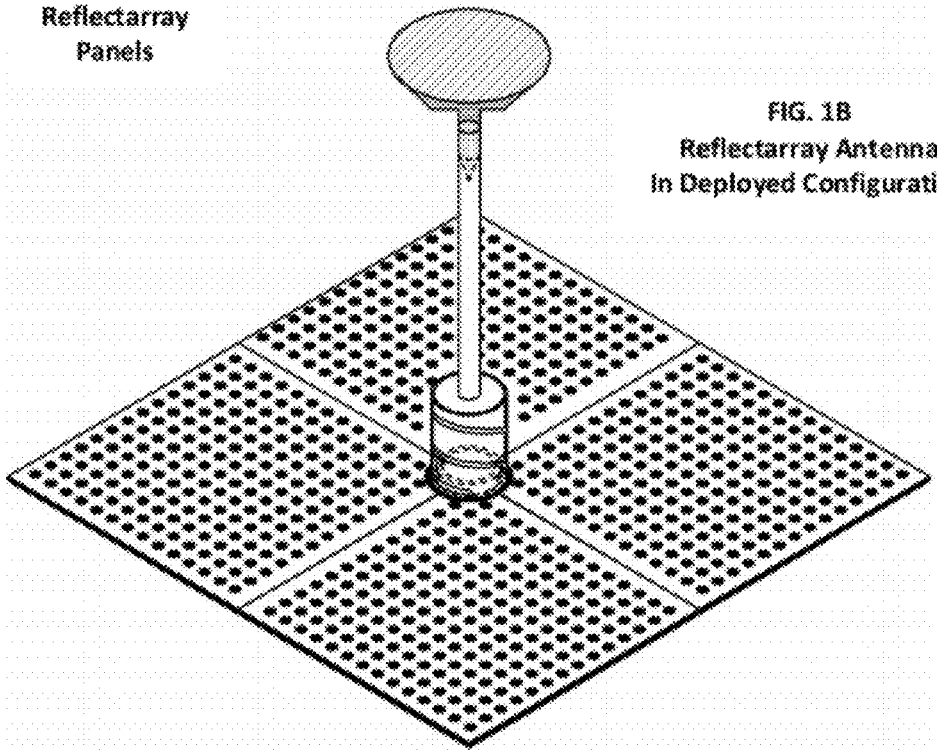

A deployable reflectarray antenna system is described that compactly packages a planar reflectarray antenna into a stack of component panels for launch and transportation and subsequently deploys them to a much larger operational antenna configuration that is combined with an integral waveguide and antenna feed. In the FIG. 1 example, four flat reflectarray panels make up the reflectarray antenna. The panels are attached by individual panel mounting brackets in the center area to the deployment mast. FIG. 1A shows the reflectarray antenna system in its stowed configuration occupying the footprint of a single flat panel. The bottom panel is fixedly attached to the bottom the deployment mast and the three movable panels are stacked above the fixed panel and vertically separated by a distance d. FIG. 1B shows the deployed configuration with a large reflective surface formed by the individual panels after being rotated and displaced downward along guide slots to lie in the plane of the bottom panel. A waveguide and antenna feed are positioned along the central axis of the cylindrical deployment mast to form a center-fed antenna system. In general a plurality of reflectarray panel shapes could be used with the constraint that they deploy into a single plane. For example, a circular-shaped antenna would have pie-shaped panels stacked in the stowed configuration and lying in a plane when deployed.

Figure 2:
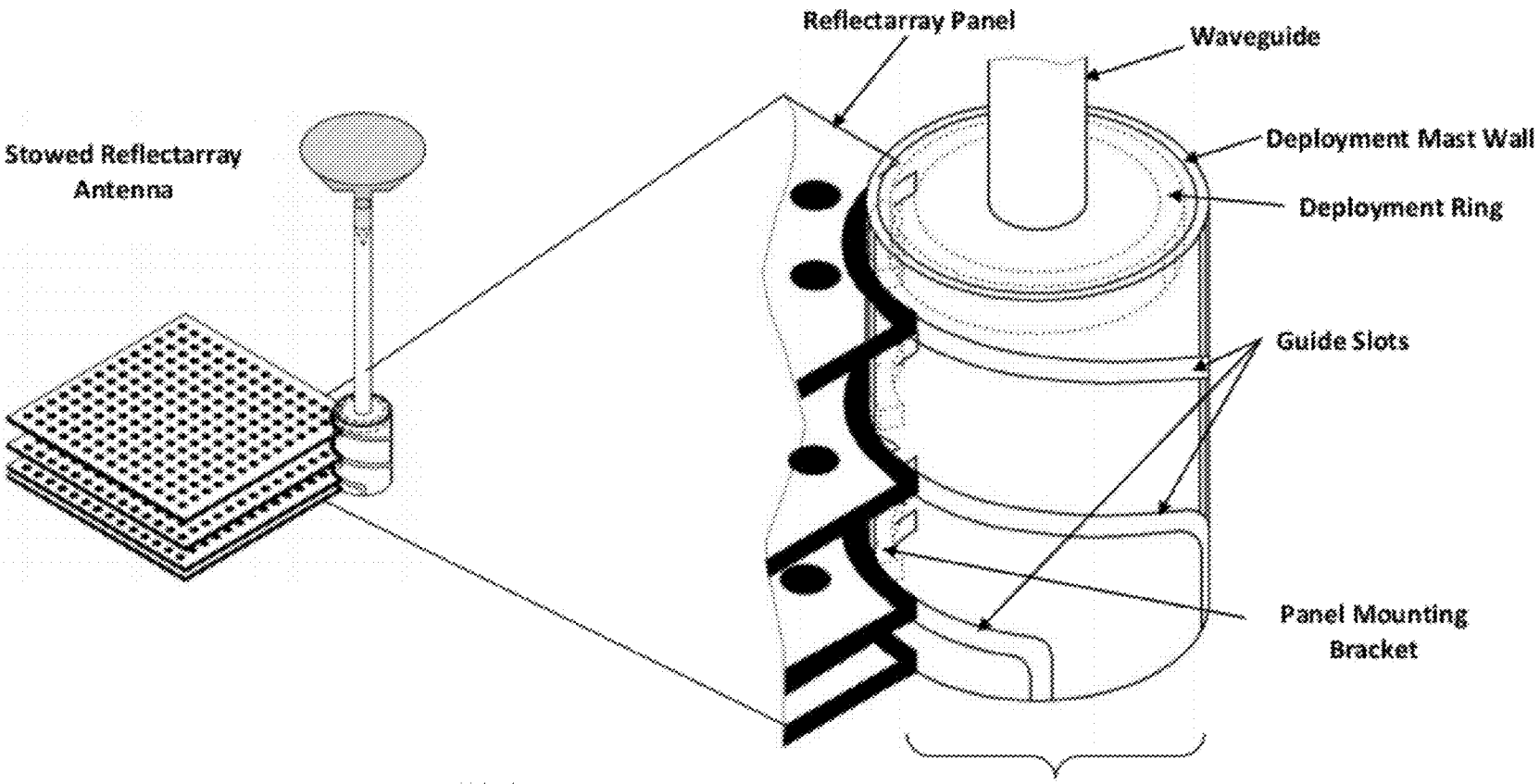
FIG. 2 shows details of the deployment mast.

Details of the deployment mast are shown in FIG. 2 in which the panels are in their stacked or packaged configuration. The deployment mast is basically a cylinder with a guide slot cut through the cylinder wall for each of the movable panels, i.e., for n panels, there would be n-1 guide slots since the bottom panel is fixedly attached to the bottom of the deployment mast. The moveable panels are attached to the mast via panel mounting brackets each having an H-shaped cross-section as shown in FIG. 3. The bracket connecting shaft of the H-shaped mounting bracket rides in the guide slot while the panel is being deployed.

The guide slots have a downward slope and then a vertical drop once they have moved through a predetermined angle about the deployment mast. When deploying, the angle the movable panels must move about the mast cylinder depends on the number of panels and their position in the stack.

Figure 5:
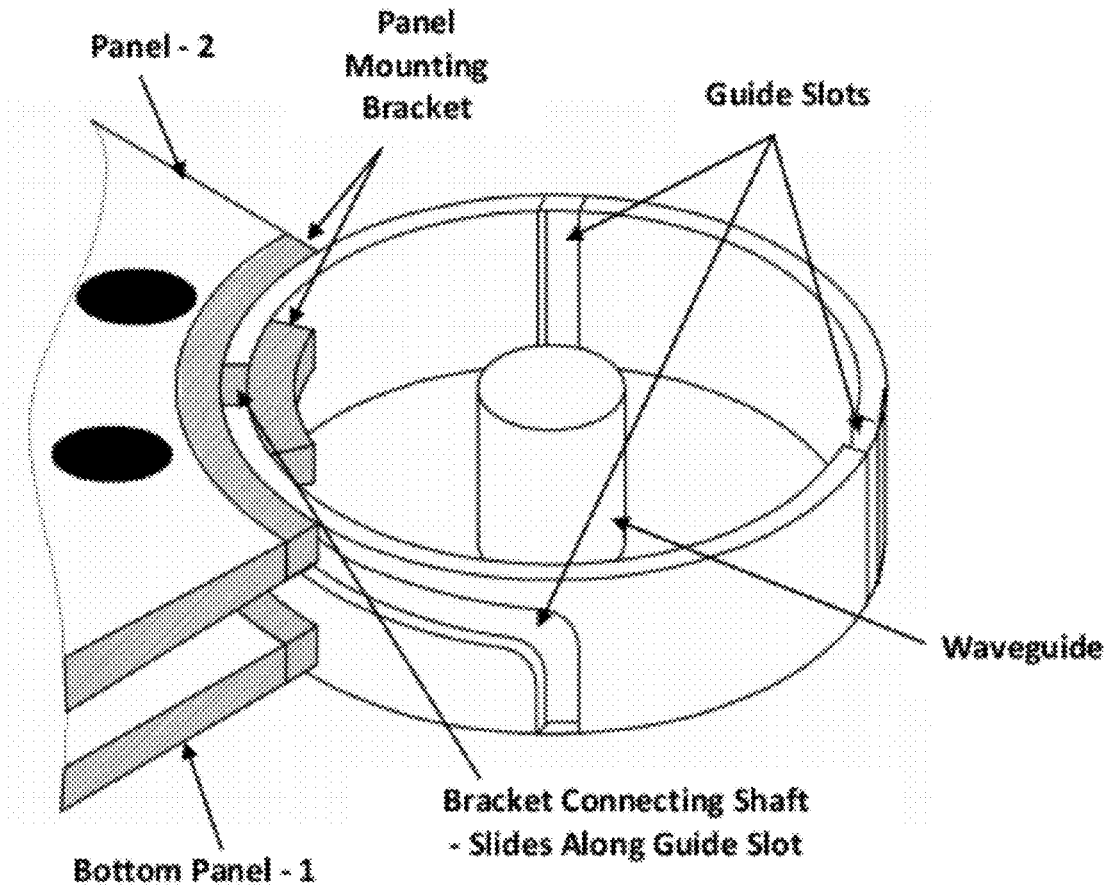
FIG. 5 is a cutaway view of the deployment mast.
Figure 6A:
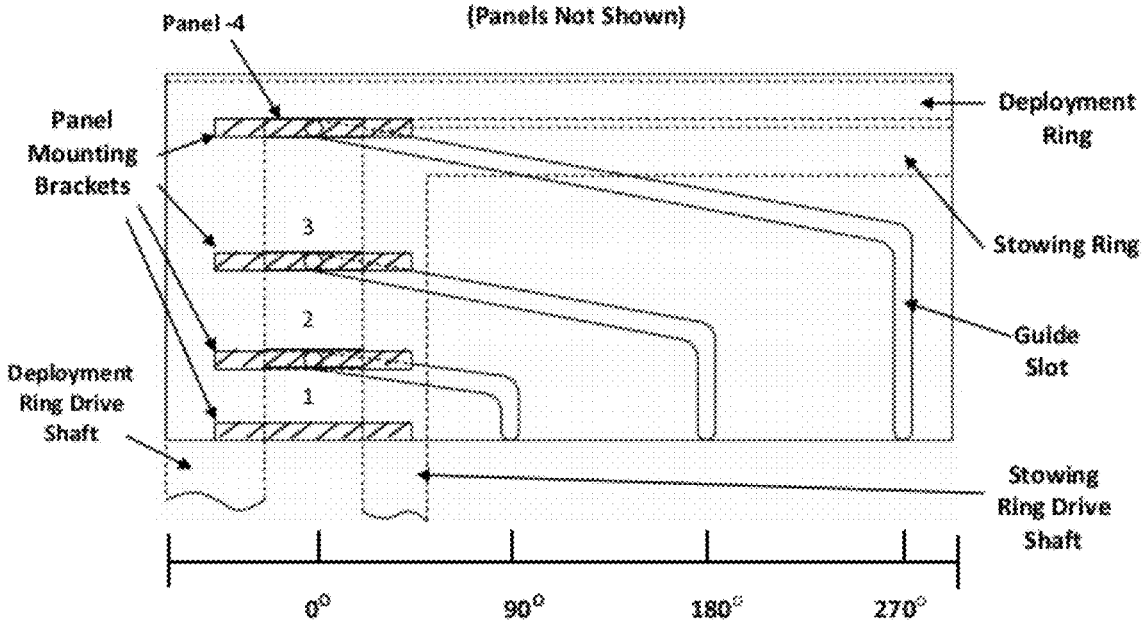
FIG. 6A shows the deployment mast outer wall flattened with the reflectarray panels in the stowed configuration.
Figure 6B:
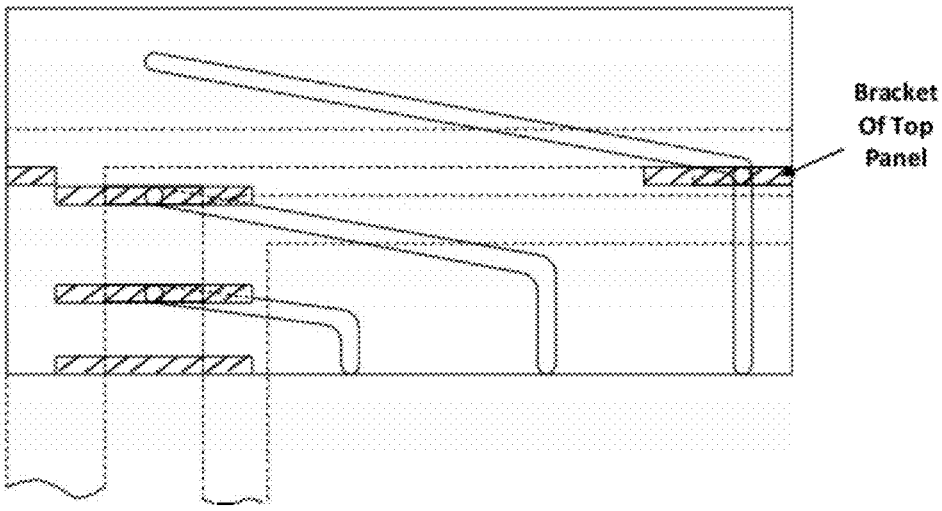
FIG. 6B shows the deployment mechanism outer wall flattened with the top reflectarray panel partially deployed.
Figure 6C:
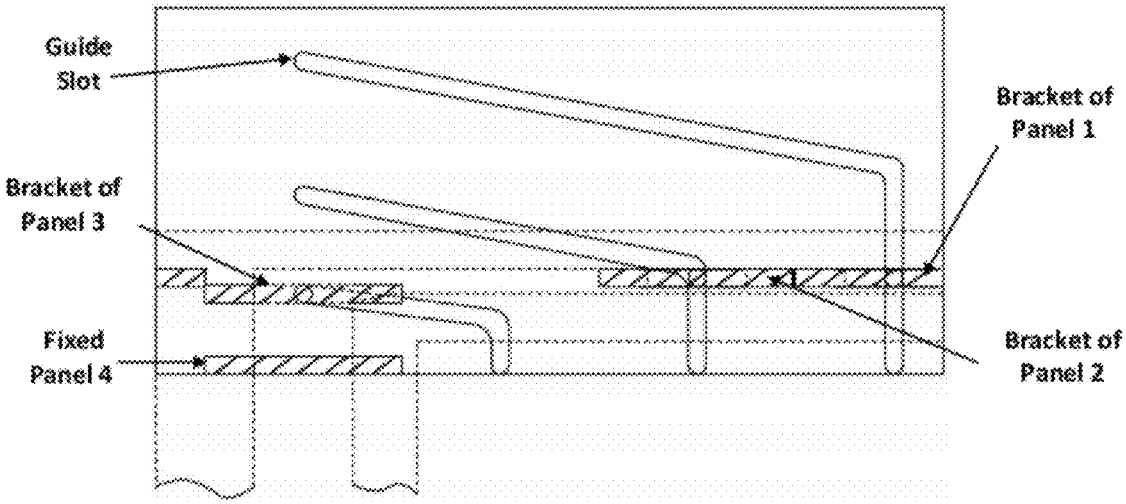
FIG. 6C shows the deployment mechanism outer wall flattened with the top and second reflectarray panels partially deployed.
Figure 6D:
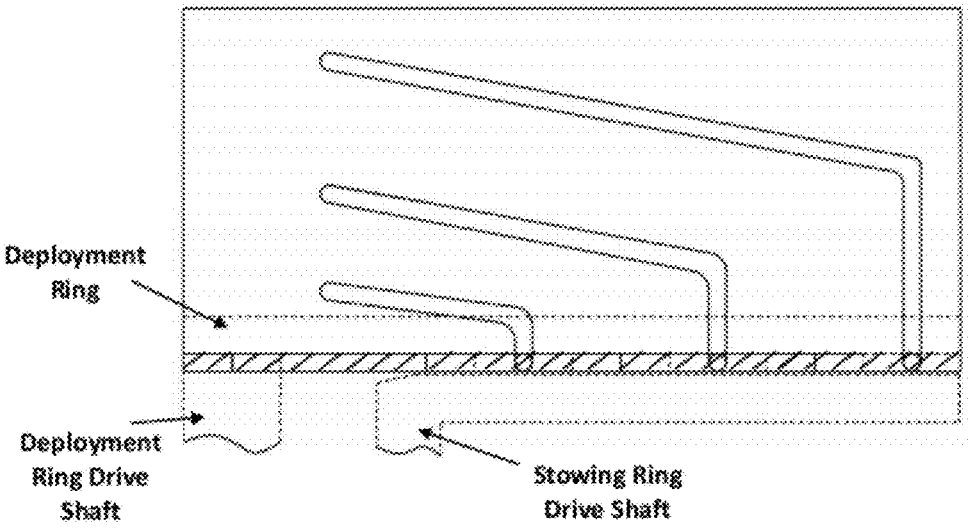
FIG. 6D shows the deployment mechanism outer wall flattened with all reflectarray panels deployed.

FIG. 4 is a top view of the deployment mast with the panels in their deployed configuration. The deployment ring is shown by dotted lines. It is attached to the deployment shaft. The deployment shaft is used to move the deployment ring downward, causing the three movable panels to rotate and descend to their deployed positions. An electrical motor or other means may be employed to move the deployment shaft. A cutaway view of the mast is shown in FIG. 5 showing additional details of the panel mounting bracket and the guide slots.

The deployment sequence is shown in four steps in FIG. 6 from a stowed position 6A to two intermediate positions 6B and 6C, to the final deployed position 6D. For this purpose, the mast wall is shown as cut vertically and flattened. The stowed configuration is shown in FIG. 6A with the deployment ring at the top of the mast and adjacent to the top panel bracket. For the four-panel example, the next to bottom panel (2) is moved 90 degrees, the panel above it (3) moves 180 degrees and the top panel (4) moves 270 degrees before arriving at the vertical portion of the slot. The vertical portion of the slot allows the panel to drop to the plane of the fixed panel (1). Prior to the deployment of a panel the stowing ring is refracted to allow motion of the panel through the guiding slot. This may be accomplished by independently actuating the stow ring (see FIG. 6), or with the stow ring joined to the deployment ring and shaft (not shown). In this example, as the deployment ring moves from its stowed position at the top of the mast to its deployed position near the bottom of the mast, it causes the top panel (4) to move 270 degrees before contacting the next panel (3). Continuing downward, it moves this next panel (3) through 180 degrees at which point it contacts the next to last panel (2) while at the same time moving the top panel (4) vertically downward. Continuing downward from there, the deployment ring moves panel (2) 90 degrees and then all three movable panels into the plane of the fixed panel (1) at which point the antenna is fully deployed.

Figure 7:
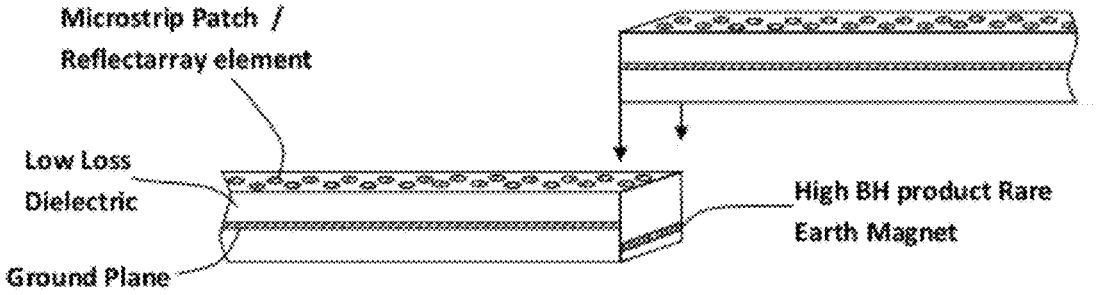
FIG. 7 is a view of two adjacent panels.

Once deployed, the adjacent edges of each reflectarray panel in its deployed configuration may be held in place by high BH product rare earth magnets as shown in FIG. 7 or may be locked in place solely by the deployment ring.

The deployment mast is a hollow cylinder with n-1 guide slots cut into the wall of the cylinder. Each guide slot is designed so that its corresponding movable panel can be moved its required angle about the mast and then dropped down to the plane of the fixed panel. The center region of the deployed reflectarray antenna is the location area of each panel where it is moveably attached to the deployment mast via its appropriate glide slot using panel mounting brackets. A waveguide is centered in the deployment mast hollow cylinder with an antenna feed at the appropriate location above the reflectarray antenna when deployed.

In going from the stowed to the deployed configuration, means for moving the movable panels within the guide slot constraints is provided. This may be done sequentially or simultaneously. A deployment ring positioned at the top of the stowed stack is one means of doing this. In the FIG. 6 sequence where the number of panels is n=4, as the deployment ring is moved downward, it first engages the top panel mounting bracket causing it to begin sliding along its guide slot, moving downward and rotating with respect to the fixed panel. When the deployment ring reaches the next lower panel's mounting bracket, the top panel has been rotated 360(n-1)/n degrees and then may drop vertically to the plane of the fixed panel. As the deployment ring continues downward, lower panels are successively rotated and dropped to the plane of the fixed panel when the full rotation angle for each panel has been reached.

Alternatively, the slope of the guide slots may be such that the downward movement of the deployment ring by a distance d causes the top panel to move 360/n degrees about the mast and downward by a distance d. The deployment ring then contacts the next highest panel's mounting bracket and moves it 360/n degrees while simultaneously moving the top panel another 360/n degrees and so on until all moveable panels have moved their predetermined angle at which point they all drop into place in the plane of the fixed panel.

In an alternative embodiment, one or more of the panels travels in a rotational direction counter to the other panels (not shown). In one example of this the top panel would rotate 90 degrees clockwise, rather than 270 degrees counter clockwise as shown in FIG. 6. This would allow for a smaller separation between each panel while maintaining the same guiding slot pitch.

In another embodiment the actuation sequence is reversed, and the panels are driven upwards rather than pulled downwards (not shown). In this alternative embodiment the fixed panel is at the top of the stowed antenna. For example, as the deployment ring moves upwards the bottom panel moves 270 degrees, the next 180, and the second to top moves 90 degrees to reach its deployed axial position. This embodiment may present advantages to the electromagnetic design, as the deployment mast would be removed from the antenna's field of view.

In embodiments with more than 4 panels, the rotation of each panel about the mast is altered accordingly. One example for the deployment of an antenna with 6 pie shaped panels utilizing a sequence similar to that in paragraphs 28,29 is as follows. The bottom moveable panel is rotated 120 degrees counter clockwise, the next 180 degrees clockwise. The third panel from the bottom is rotated 60 degrees counter clockwise and the fourth and fifth from the bottom are rotated 120 and 60 degrees clockwise respectively. When deployed these panels comprise a backfire fed circular reflectarray, rather than the square reflectarray shown.

The invention claimed is:

1. A center-fed flat deployable reflectarray antenna system having a deployable reflector with a center area, a deployment mast, a waveguide, and an antenna feed, the antenna system comprised of:

a. a flat reflectarray antenna that in a deployed configuration is subdivided into a plurality of n flat panels of equal size about its center with panel mounting brackets attached to each of said panels at the panel region adjacent to the center area;

b. a deployment mast comprised of a hollow cylinder wall having an inner and outer surface with a cylinder central axis aligned vertically and top and bottom ends and with n-1 guide slots cut through the wall and through which the panel mounting brackets are moveably attached, a first panel fixedly attached to the base of the outer wall surface of said hollow cylinder in a plane perpendicular to said central axis, said guide slots so arranged such that in a stacked configuration the n-1 movable panels can be vertically stacked over the fixed panel and vertically separated one from the other by a small distance d and further said guide slots arranged to permit said stacked moveable panels to move predetermined multiples of 360/n degrees after which said panels drop vertically downward simultaneously within said guide slots to form a uniform planar reflectarray antenna reflector in the plane of the fixed panel;

c. means for moving said moveable panels along said guide slots from the stacked configuration to the deployed configuration; and d. a waveguide with an antenna feed on one end and centered about the central axis of said hollow cylinder such that said antenna feed extends an appropriate distance above said reflectarray antenna in its deployed configuration.

2. The flat deployable reflectarray antenna system of claim 1, wherein the guide slots for said moveable panels are arranged such that in going from a stacked to a deployed configuration, said panels are sequentially moved their predetermined angle with respect to the fixed panel and dropped to the plane of the fixed panel.

3. The deployment mechanism of claim 1, wherein the means for moving said moveable panels along said guide slots from the stacked configuration to the deployed configuration is a deployment ring located at the top of the mast and in contact with the panel mounting bracket of the top movable panel that when displaced downward causes said movable panels to rotate and move downward within their guide slots to the deployed configuration.

4. The flat deployable reflectarray antenna system of claim 1, wherein adjacent edges of said n flat panels in the deployed configuration have imbedded high maximum energy product magnets to improve structural stability to the deployed antenna surface.

5. A deployment mechanism for a deployable reflectarray antenna having a center area comprised of:

a. a flat reflectarray antenna that in a deployed configuration is subdivided into a plurality of n flat panels of equal size about its center with panel mounting brackets attached to each of said panels at the panel region adjacent to the center area;

b. a deployment mast comprised of a hollow cylinder wall having an inner and outer surface with a cylinder central axis aligned vertically and top and bottom ends and with n-1 guide slots cut through the wall and through which the panel mounting brackets are moveably attached, a first panel fixedly attached to the base of the outer wall surface of said hollow cylinder in a plane perpendicular to said central axis, said guide slots so arranged such that in a stacked configuration the n-1 movable panels can be vertically stacked over the fixed panel and vertically separated one from the other by a small distance d and further said guide slots arranged to permit said stacked moveable panels to move predetermined multiples of 360/n degrees after which said panels drop vertically downward simultaneously within said guide slots to form a uniform planar reflectarray antenna reflector in the plane of the fixed panel; and c. means for moving said moveable panels along said guide slots from the stacked configuration to the deployed configuration.

6. The deployment mechanism of claim 5, wherein the means for moving said moveable panels along said guide slots from the stacked configuration to the deployed configuration is a deployment ring located at the top of the mast and in contact with the panel mounting bracket of the top movable panel that when displaced downward causes said movable panels to rotate and move downward within their guide slots to the deployed configuration.

7. The flat deployable reflectarray antenna of claim 5, wherein the guide slots for said moveable panels are arranged such that in going from a stacked to a deployed configuration, said panels are sequentially moved their predetermined angle with respect to the fixed panel and dropped to the plane of the fixed panel.

8. The flat deployable reflectarray antenna of claim 5, wherein adjacent edges of said n flat panels in the deployed configuration have imbedded high maximum energy product magnets to improve structural stability to the deployed antenna surface.

* * * * *